United States Patent [19]

Kimura et al.

[11] Patent Number: 4,638,304

[45] Date of Patent: Jan. 20, 1987

[54] ENVIRONMENTAL ABNORMALITY DETECTING APPARATUS

[75] Inventors: Tetsuo Kimura, Tokyo; Seiichi Tanaka, Chiba; Takasi Suzuki, Tokyo, all of Japan

[73] Assignee: Nittan Co., Ltd., Tokyo, Japan

[21] Appl. No.: 680,768

[22] Filed: Dec. 12, 1984

[30] Foreign Application Priority Data

Dec. 13, 1983 [JP] Japan ..... 58-233692

[51] Int. Cl.[4] ..... G08B 23/00; G08B 17/10

[52] U.S. Cl. ..... 340/500; 340/511; 340/628; 340/632; 340/630; 340/661; 340/870.16; 250/565

[58] Field of Search ..... 340/500, 501, 507, 506, 340/509, 510, 511, 514, 537, 588, 589, 657, 660, 661, 870.16, 870.17, 870.13, 628, 630, 632; 250/565; 307/356

[56] References Cited

U.S. PATENT DOCUMENTS

| | | | |
|---|---|---|---|
| 3,872,449 | 3/1975 | Scheidweiler | 328/127 |
| 4,078,156 | 3/1978 | Langah | 340/870.13 |
| 4,146,750 | 3/1979 | Spiesmah | 340/870.13 |
| 4,254,414 | 3/1981 | Street et al. | 340/628 |
| 4,414,539 | 11/1983 | Armer | 340/514 |
| 4,517,554 | 5/1985 | Moser et al. | 340/514 |

*Primary Examiner*—Donnie L. Crosland

*Attorney, Agent, or Firm*—Hill, Van Santen, Steadman & Simpson

[57] ABSTRACT

An environmental abnormality detecting apparatus for detecting abnormality in atmosphere such as heat, smoke, and a gas. A sampling circuit is provided for periodically sampling analog signals from a detector for detecting these phenomena. A quantizer quantizes sampled signals with step levels. An accumulator having a plurality of counters provides different accumulation times corresponding to the step levels. Reliability in accumulation effect is not degraded, and an abnormality signal can be detected in a short period of time when a degree of abnormality is high.

11 Claims, 4 Drawing Figures

S7
THE COUNT OF THE COUNTER CNT2 IS n2
CNT2 = n2?
YES
NO
S8
COMPARES THE DETECTION VOLTAGE e0 WITH THE COMPARISON VOLTAGE E3'
e0 ≧ E3'?
NO
YES
S9
THE COUNTER CNT3 TO INCREMENT BY ONE
CNT3 + 1 → CNT3
S14
THE COUNTER CNT3 IS REST TO ZERO
0 → CNT3
S10
THE COUNT OF THE COUNTER CNT3 IS n3
CNT 3 = n3?
YES
NO
S11
OUTPUT ABNORMALITY DETECTION SIGNAL
S15

ENVIRONMENTAL ABNORMALITY DETECTING APPARATUS

BACKGROUND OF THE INVENTION

The present invention relates to an environmental abnormality detecting apparatus for detecting an analog signal representing an abnormality in smoke, heat, gas or the like and producing an alarm.

An accumulator type fire detector is one type of conventional smoke detector for detecting a fire which has been proposed wherein analog smoke signals are accumulated in an accumulator and the fire detector is started when an accumulation level exceeds a predetermined level so as to improve reliability. However, according to this conventional fire detector, even if a level of the analog signal is extremely high, it takes a long period of time to operate the fire detector, resulting in inconvenience. An example of such a conventional accumulator type fire detector is described in U.S. Pat. No. 3,872,449, incorporated herein by reference.

SUMMARY OF THE INVENTION

The present invention eliminates this conventional drawback, and has as its object to provide a highly reliable environmental abnormality detecting apparatus which immediately produces an alarm when an analog signal has a high level, but in which the effect of an accumulator is not degraded.

In order to achieve the above object of the present invention, there is provided an environmental abnormality detecting apparatus as claimed in claim 1 which comprises: a detector for detecting analog information representing changes in environmental factors such as smoke, heat and gas and for converting the analog information to an electrical analog signal; a sampling circuit for sampling analog signals from the detector after every predetermined time interval; a quantizer for converting an output signal from said sampling circuit to a stepwise signal and for generating a plurality of outputs in units of step levels; and accumulating means having different accumulation times for the respective step levels of the quantizer.

DESCRIPTION OF THE PREFERRED EMBODIMENTS

An environmental abnormality detecting apparatus according to an embodiment of the present invention will be described with reference to the accompanying drawings.

Figure 1:
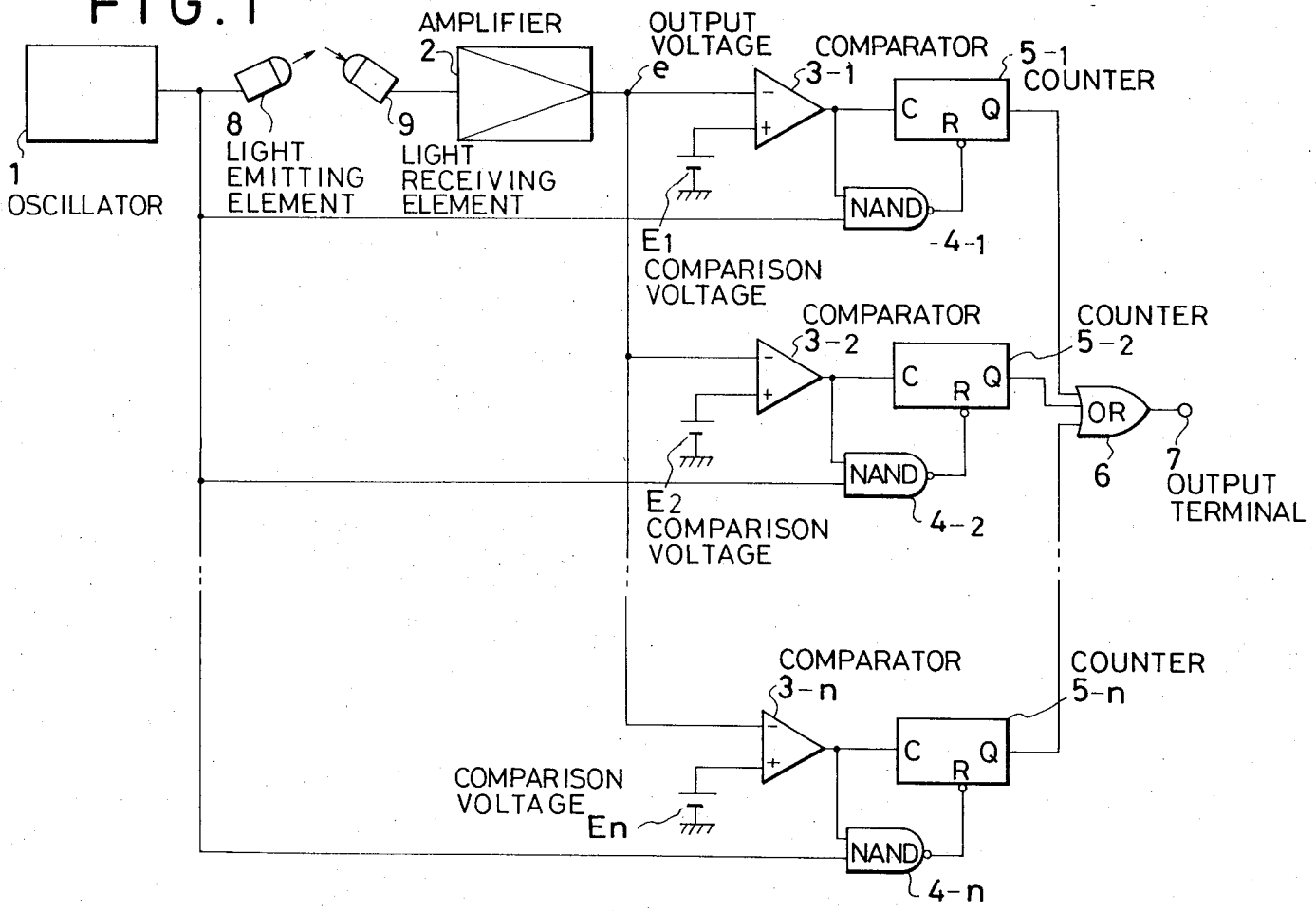
FIG. 1 is a block diagram of an environmental abnormality detecting apparatus according to the present invention.

FIG. 1 is a block diagram of the environmental abnormality detecting apparatus according to this embodiment. The detecting apparatus detects smoke concentration by a light-scattering effect and hence a fire. This detecting apparatus comprises: a light-emitting element 8 such as a light-emitting diode for emitting light in a region of interest for smoke detection; an oscillator 1 for intermittently driving the light-emitting element 8; a light-receiving element 9 arranged in a structure which does not receive direct light from the light-emitting element 8 but receives only light scattered by smoke; an amplifier 2 for properly amplifying to a given magnitude a detection signal generated from the light-receiving element 9; a plurality of comparators 3-1 to **3-*n* for respectively comparing the output from the amplifier 2 with a plurality of comparison step voltages E1 to En; a plurality of 2-input NAND gates 4-1 to 4-*n* for receiving the output from the oscillator 1 and the output signals from the comparators 3-1 to 3-*n*; a plurality of counters 5-1 to 5-*n*, reset in response to the outputs from the 2-input NAND gates 4-1 to 4-*n*, for counting the number of pulses of the output signals from the comparators 3-1 to 3-*n* and for generating high level (to be referred to as an H hereinafter) signals from output terminals Q thereof when counts of the respective counters 5-1 to 5-*n* have reached different predetermined values, respectively; and a multi-input OR gate 6 for receiving a plurality of signals from the output terminals Q and generating a smoke detection signal which appears at an output terminal 7**.

The operation of the environmental abnormality detecting apparatus having the arrangement described above will now be described. The oscillator 1 generates pulses at a predetermined period T to intermittently drive the light-emitting element 8. The pulse signal from the oscillator 1 sets the input terminals of the plurality of 2-input NAND gates 4-1 to **4-*n* at an H level. In a normal condition, i.e., when no smoke is present, an output voltage e from the amplifier 2 is lower than all the comparison voltages E1 to En. In this case, all the outputs from the comparators 3-1 to 3-*n* are set at the H level. Signals of the H level are respectively supplied to the 2-input NAND gates 4-1 to 4-*n*. Outputs from the 2-input NAND gates 4-1 to 4-*n* are set at low level (to be referred to as an L hereinafter), so that the counters 5-1 to 5-*n*** are reset.

By way of simplicity, assume that the comparison voltages E1 to En satisfy the relation $E1>E2>\ldots>En$, and that the counters 5-1 to **5-*n* generate H signals when counts of the counters 5-1 to 5-*n* are $2^1$, $2^2$, . . . , and $2^n$. When a smoke concentration is relatively low and the output voltage e from the amplifier 2 satisfies the inequality $En\text{-}1>e>En$, only the counter 5-*n* is enabled. When this state is maintained longer than an accumulation time t ($t=2^n \cdot T$), the output from the counter 5-*n* goes to the H level. A detection signal of the H level then appears at the output terminal 7 through the multi-input OR gate 6. When a smoke concentration is high and the output voltage e from the amplifier 2 exceeds the comparison voltage E1, all the counters 5-1 to 5-*n* are enabled. An output Q is generated from the counter t-1** at a shortest accumulation time t ($=2 \cdot T$). An alarm unit, a security unit, or the like (not shown) is driven in response to this detection signal.

As is apparent from the above description, when the smoke concentration is high, the smoke detection signal is immediately detected over a short accumulation time. However, when the smoke concentration is low, the smoke detection signal is slowly detected over a long period of time. The comparison voltages E1 to En and the counts of the counters 5-1 to **5-*n*** are properly determined in association with the smoke concentration so as to obtain an inverse proportionality between the smoke concentration and the accumulation time, thereby obtaining highly reliable detection.

Referring to FIG. 1, the light-emitting element 8, the light-receiving element 9, and the amplifier 2 constitute a detector for converting smoke concentration analog information to an analog voltage signal. The oscillator 1 and the 2-input NAND gates 4-1 to **4-*n* constitute a sampling circuit for extracting an analog signal at every sampling period. The plurality of comparators 3-1 to 3-*n* constitute a quantizer, and the plurality of counters 5-1 to 5-*n*** constitute an accumulating means.

Figure 2:
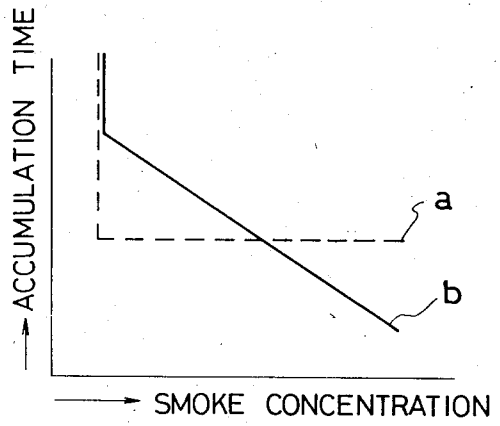
FIG. 2 is a graph showing operating characteristics of the apparatus of FIG. 1 in comparison with those of a conventional apparatus.

FIG. 2 is a graph showing the relationship between the accumulation time and the smoke concentration of the detecting apparatus of the present invention, indicated by a solid line b, in comparison with that of a conventional apparatus, indicated by a dotted line a. In the conventional apparatus, even if a smoke concentration is high, a long accumulation time is required. However, according to the present invention, when the smoke concentration is increased, the accumulation time becomes short (the accumulation time may become zero as needed) in accordance with the degree of abnormality.

In the embodiment shown in FIG. 1, a single detecting apparatus is illustrated. However, when a plurality of detection signals from a fire alarm system which covers a wide monitor area are monitored at a concentrated central station, the analog signals from the detectors are monitored by the central station in accordance with polling or the like. In this case, when signal processing is performed by a microcomputer arranged in the central station, a very simple circuit configuration can be obtained without arranging a complicated circuit in each of the detecting apparatuses, resulting in low cost.

Figure 3A:
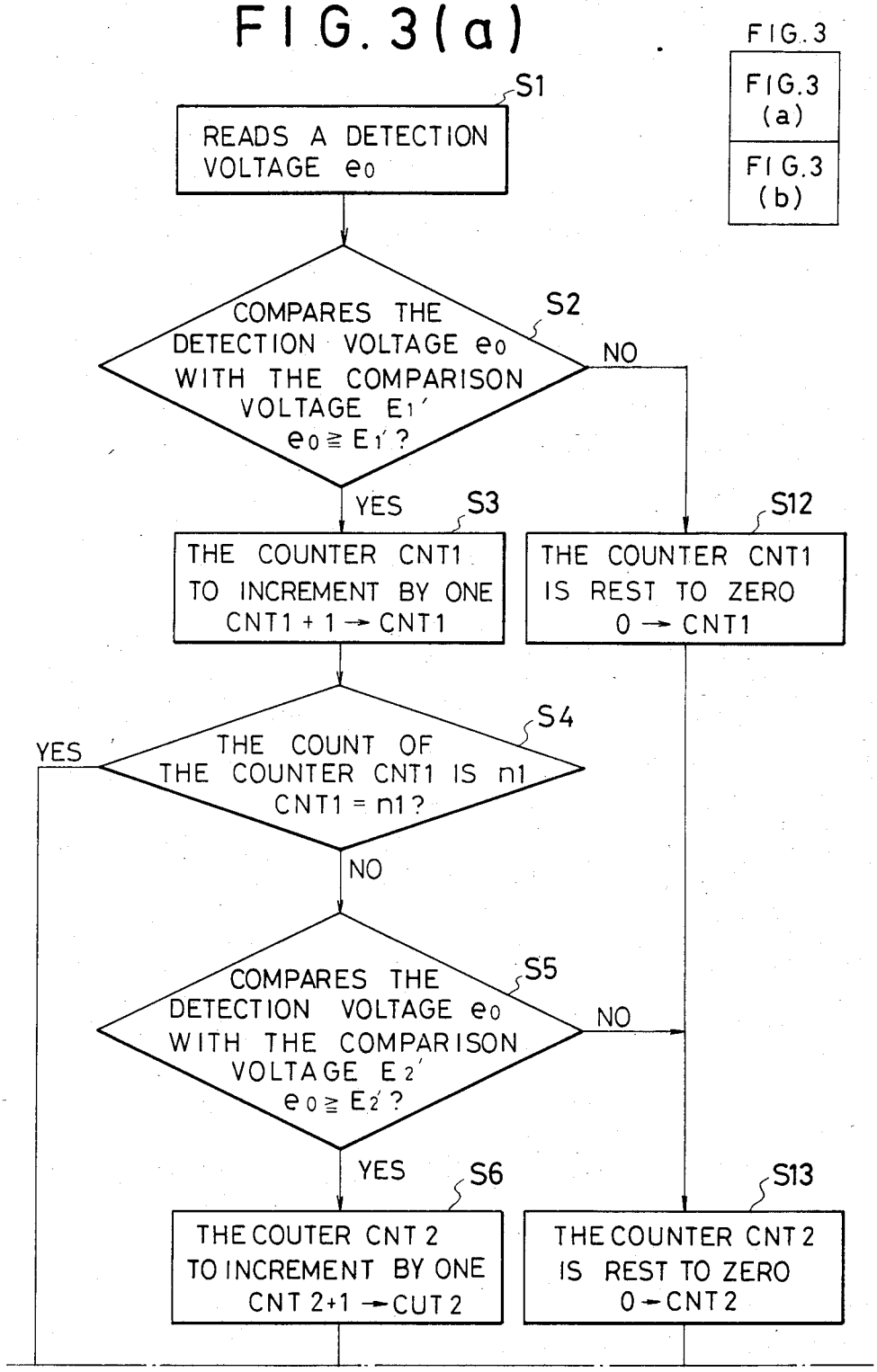
FIGS. 3A and 3B are flow charts for explaining signal processing of the apparatus shown in FIG. 1.
Figures 3, 3B:
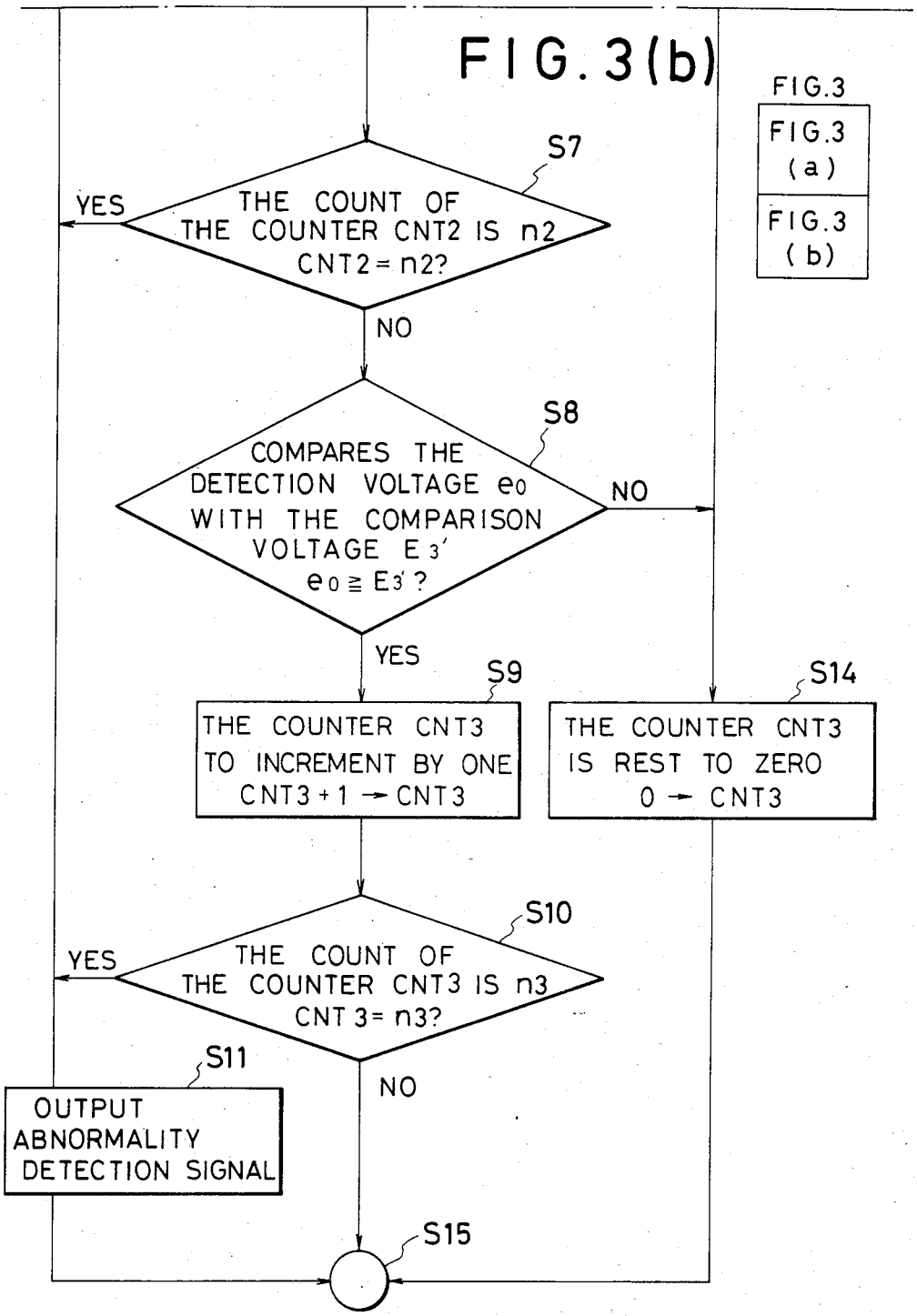

Signal processing for smoke detection by a computer in accordance with a program will be described with reference to a flow chart in FIG. 3. Assume that comparison voltages E1′, E2′, and E3′ satisfy the inequality $E1' < E2' < E3'$, and that counts n1, n2, and n3 satisfy the inequality $n1 > n2 > n3$. In step S1, the microcomputer reads a detection voltage e0 using an analog to digital converting means which functions as a quantizer as an analog signal from a given detector, and the flow advances to step S2. In step S2, the microcomputer compares the detection voltage e0 with the comparison voltage E1′ and checks whether or not inequality $e0 \geqq E1'$ is established. If YES in step S2, the flow advances to step S3. However, if NO in step S2, the flow advances to step S12. In step S12, a counter CNT1 is reset to zero. Thereafter, the flow advances to step S13. In step S3, the microprocessor causes the counter CNT1 to increment by one, and the flow advances to step S4. The microprocessor checks in step S4 whether or not the count of the counter CNT1 is n1. If YES in step S4, the flow advances to step S11. However, if NO in step S4, the flow advances to step S5. In step S5, the microprocessor compares the detection voltage e0 with the comparison voltage E2′ and checks whether or not inequality $e0 \geqq e2'$ is established. If YES in step S5, the flow advances to step S13. The counter CNT2 is reset to zero in step S13, and the flow advances to step S14. However, as described above, if YES in step S5, the count of the counter CNT2 is incremented by one in step S6, and the flow advances to step S7. The microprocessor checks in step S7 whether or not the count of the counter CNT2 is n2. If YES in step S7, the flow advances to step S11. However, if NO in step S7, the flow advances to step S8. In step S8, the microprocessor compares the detection voltage e0 with the comparison voltage E3′ and checks whether or not the inequality $e0 \geqq e3'$ is established. If YES in step S8, the flow advances to step S9. However, if NO in step S8, the flow advances to step S14. In step S14, a counter CNT3 is reset to zero, and the flow advances to step S15. However, when step S9 is executed, the count of the counter CNT3 is incremented by one, and the flow advances to step S10. The microprocessor checks in step S10 whether or not the count of the counter CNT3 is n3. If YES in step S10, the flow advances to step S11. However, if NO in step S10, the flow advances to step S15. Step S11 is the step for generating an abnormality detection signal when the step S4, S7, or S10 is judged to be YES. When step S11 is completed, the flow advances to step S15. Step S15 represents a node for another program. When a predetermined period of time has elapsed, the flow returns to step 1 for reading a detection voltage e0 from another or the same detector. When the read period for reading the detection voltage e0 from the same detector is T0, accumulation times of the counters CNT1 to CNT3 are T0·n1, T0·n2, and T0·n3, respectively. The counters CNT1 to CNT3 are reset to zero in steps S12, S13, and S14, respectively. However, when the counts of the counters CNT1 to CNT3 are not zero, highly reliable detection operation is performed by subtractions, respectively.

The present invention is not limited to an optical smoke detecting apparatus but can be extended to a detection apparatus for detecting an analog signal of a temperature, a gas, or the like and detecting an abnormality in accordance with the magnitude of the analog signal.

As has been described above, in the detection function of the environmental abnormality detecting apparatus, an abnormality detection time varies in accordance with a degree of abnormality given by an analog signal representing a certain phenomenon, thereby greatly improving reliability and optimizing the detection time.

Although various minor changes and modifications might be proposed by those skilled in the art, it will be understood that we wish to include within the claims of the patent warranted hereon all such changes and modifications as reasonably come within our contribution to the art.

We claim as our invention:

1. An environmental abnormality detecting apparatus, comprising:

a detector means for detecting analog information representing changes in an environmental parameter and for converting the analog information to an electrical analog signal;

a sampling circuit means for providing at predetermined time intervals the analog signal from said detector means;

a quantizer means for converting the analog signals from said sampling circuit means from one up to a plurality of n level-dependent signals, the number of signals being output depending upon an amplitude of the analog signal; and accumulating means having n different accumulation times each of which corresponds to one of the n level-dependent signals received from said quantizer means, said accumulating means thus accumulating time dependent upon the amplitude of the analog signal.

2. An apparatus according to claim 1 wherein said accumulating means comprises a plurality of counting means for generating abnormality detection signals when predetermined different counts of said counting means correspond to the different level-dependent signals of said quantizer means.

3. An apparatus according to claim 2 wherein each of said plurality of counting means respectively comprise means for clearing a corresponding one of the counts corresponding to the respective level-dependent signal when said quantizer means does not output the corresponding level-dependent signal.

4. An apparatus according to claim 1 wherein said sampling circuit means comprises an oscillator means as a periodic driver for the detector means, said quantizer means comprises a plurality of respective comparators each having at one input the analog signals and at its other input a comparison voltage source which differs for each comparator, and wherein said accumulation means comprises a plurality of counters for receiving a respective level-dependent signal output from the respective comparator.

5. An apparatus according to claim 4 wherein said sampling circuit means further comprises logic means for resetting the counters in the accumulation means whenever the comparator does not output a signal as a result of the analog signal present at its input.

6. An apparatus for detecting an environmental parameter, comprising:

means for detecting analog information representing changes in an environmental parameter and for converting the analog information to an electrical analog signal;

first and second comparator means for comparing a magnitude of the electrical analog signal to respective first and second reference levels in the respective first and second comparator means and providing respective first and second outputs given a desired comparison, the first reference level being different than the second reference level;

first and second timer means respectively connected to the first and second comparator means for receiving the respective first and second outputs from the respective comparator means whenever the analog signal has the desired comparison with the respective reference level, each of said timer means having an output when a predetermined respective time is reached, the time for the first timer differing from the time for the second timer so that time is accumulated dependent upon the magnitude of the analog information; and means for providing said timer means outputs to activate an indicating apparatus.

7. An apparatus according to claim 6 wherein resetting means are provided for resetting timing initiation of the respective timer means when the respective comparator means does not output a signal and when an anlog signal is being received by the comparator means.

8. An apparatus according to claim 6 wherein the first and second timer means comprise counter means which produce their respective outputs at different total counts.

9. A method for detecting an environmental parameter, comprising the steps of:

detecting analog information representing changes in an environmental parameter and for converting the analog information to an electrical analog signal;

comparing a magnitude of the electrical analog signal to respective first and second reference levels in respective first and second comparison steps and providing respective first and second outputs given a respective desired comparison, the first reference level being different than the second reference level;

providing a timing circuit for the outputs of the respective comparison steps which provides a control output after a predetermined time, said predetermined time having a first value in response to the first output and a second different value in response to the second output so that the predetermined time is dependent upon the magnitude of the analog information; and providing the control output to activate an indicating apparatus.

10. A system for detecting an environmental paramter, comprising the steps of:

means for detecting analog information representing changes in an environmental parameter and for converting the analog information to an electrical signal;

means for comparing a magnitude of the electrical signal to at least first and second reference levels and for providing respective first and second outputs given respective desired comparisons, the first reference level being different than the second reference level; and timing circuit means connected to receive the first and second outputs and for providing a control output after a predetermined time, said predetermined time having a first value in response to the first output and a second different value in response to the second output so that the predetermined time is dependent upon the magnitude of the detected analog information.

11. A system according to claim 10 wherein the environmental parameter comprises smoke and the timing circuit means predetermined time at which the control output is provided decreases with increasing smoke concentration.

* * * * *